US009599423B2

(12) United States Patent
Hines

(10) Patent No.: US 9,599,423 B2
(45) **Date of Patent: *Mar. 21, 2017**

(54) GRIP/COVER FOR KEY LOCK SYSTEM

(71) Applicant: Falcon Industries, Inc., Edgewood, NM (US)

(72) Inventor: Stephen Charles Hines, Edgewood, NM (US)

(73) Assignee: Falcon Industries, LLC, Edgewood, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,145

(22) Filed: Aug. 16, 2016

(65) Prior Publication Data

US 2016/0356569 A1 Dec. 8, 2016

Related U.S. Application Data

(63) Continuation of application No. 14/865,692, filed on Sep. 25, 2015, now Pat. No. 9,441,905, which is a continuation-in-part of application No. 14/593,134, filed on Jan. 9, 2015, now Pat. No. 9,234,721, which is a continuation of application No. 29/478,902, filed on Jan. 9, 2014, now Pat. No. Des. 734,418, application No. 15/238,145, which is a continuation of application No. 15/015,773, filed on Feb. 4, 2016, now Pat. No. 9,448,030, which is a continuation-in-part of application No. 14/865,692, and a continuation-in-part of application No. 13/800,887, filed on Mar. 13, 2013, now Pat. No. 9,279,639.

(60) Provisional application No. 61/925,451, filed on Jan. 9, 2014, provisional application No. 62/232,393, filed on Sep. 24, 2015, provisional application No. 62/056,172, filed on Sep. 26, 2014, provisional application No. 61/778,407, filed on Mar. 12, 2013, provisional application No. 61/610,281, filed on Mar. 13, 2012.

(51) Int. Cl.

| | |
|---|---|
| ***F41A 17/20*** | (2006.01) |
| ***F41A 35/00*** | (2006.01) |
| ***F41C 23/16*** | (2006.01) |

(52) U.S. Cl.

CPC ..... *F41A 35/00* (2013.01); *F41C 23/16* (2013.01)

(58) Field of Classification Search

CPC ..... F41C 23/16; F41C 23/10; F41A 17/066; F41A 17/20; F41A 17/02

USPC ..... 42/71.02, 71.01, 72, 90, 70.11, 111

See application file for complete search history.

(56) References Cited

U.S. PATENT DOCUMENTS

| | | | |
|---|---|---|---|
| 3,128,571 | A | 4/1964 | Herrett |
| 5,392,550 | A | 2/1995 | Moore et al. |
| 5,522,166 | A | 6/1996 | Martel |
| 6,487,804 | B1 | 12/2002 | Petrella, Jr. |
| 7,627,975 | B1 | 12/2009 | Hines |
| 8,091,265 | B1 | 1/2012 | Teetzel et al. |

(Continued)

*Primary Examiner* — Michael David

(74) *Attorney, Agent, or Firm* — Richard H. Krukar; Luis M. Ortiz; Kermit D. Lopez

(57) ABSTRACT

Covers for key lock mounting systems on small arms such as the AR or M4 family of rifles and carbines can provide protection for the firearm and comfort for the operator. The cover has keyhole grips that are pressed into the key lock mounting points in mounting system. The cover is held seated against the surface of the mounting system by the shape and resilience of keyhole grips. V-notch keyhole grips can attach to keyhole shaped mounting points and slot shaped mounting points.

5 Claims, 12 Drawing Sheets

(56) References Cited

U.S. PATENT DOCUMENTS

| | | | |
|---|---|---|---|
| 8,931,197 | B2 | 1/2015 | Larson |
| 8,959,820 | B2 | 2/2015 | Larson, Jr. |
| 9,222,749 | B1 | 12/2015 | Nakayama et al. |
| 2003/0106252 | A1 | 6/2003 | Hines |
| 2008/0289237 | A1 | 11/2008 | Pikielny |
| 2009/0241397 | A1 | 10/2009 | Fitzpatrick et al. |
| 2010/0175293 | A1 | 7/2010 | Hines |
| 2010/0192446 | A1 | 8/2010 | Darian |
| 2010/0192448 | A1 | 8/2010 | Darian |
| 2010/0214470 | A1 | 8/2010 | Cottagnoud |
| 2010/0275489 | A1 | 11/2010 | Cabahug et al. |
| 2011/0000120 | A1 | 1/2011 | Thompson |
| 2011/0167698 | A1 | 7/2011 | Hogue |
| 2011/0192066 | A1 | 8/2011 | Kimmel et al. |
| 2011/0232149 | A1 | 9/2011 | Fargnoli et al. |
| 2012/0085013 | A1 | 4/2012 | Cahill |
| 2012/0311906 | A1 | 12/2012 | Troy et al. |
| 2013/0019510 | A1 | 1/2013 | Kemmerer et al. |
| 2013/0019512 | A1 | 1/2013 | Kemmerer et al. |
| 2013/0074394 | A1 | 3/2013 | Larue |
| 2013/0125441 | A1 | 5/2013 | Westwood et al. |
| 2014/0013642 | A1 | 1/2014 | Larson, Jr. |
| 2014/0157639 | A1 | 6/2014 | Larson, Jr. |
| 2014/0298703 | A1 | 10/2014 | Gale et al. |
| 2014/0325889 | A1 | 11/2014 | Michal et al. |
| 2015/0096215 | A1 | 4/2015 | Somogy et al. |
| 2015/0128470 | A1 | 5/2015 | Troy, Jr. |
| 2015/0192386 | A1 | 7/2015 | Hines |
| 2015/0198408 | A1 | 7/2015 | Kincel et al. |
| 2015/0219422 | A1 | 8/2015 | Kincel |
| 2015/0241169 | A1 | 8/2015 | Cheng et al. |
| 2015/0285583 | A1 | 10/2015 | Mayberry et al. |
| 2015/0285584 | A1 | 10/2015 | Mayberry et al. |
| 2015/0323284 | A1 | 11/2015 | Larson, Jr. |
| 2016/0084610 | A1 | 3/2016 | Wood et al. |
| 2016/0091272 | A1 | 3/2016 | Hines |
| 2016/0116252 | A1 | 4/2016 | Kincel |

GRIP/COVER FOR KEY LOCK SYSTEM

RELATED APPLICATIONS

This application is a continuation of U.S. patent application Ser. Nos. 14/865,692 and 15/015,773, and claims the benefit and priority of U.S. patent application Ser. Nos. 13/800,887, 14/593,134 and 29/478,902, and claims the priority and benefit of U.S. Provisional Applications 62/056,172, 62/232,393, 61/925,451, 61/610,281, and 61/778,407. U.S. patent application Ser. No. 14/865,692 was filed Sep. 25, 2015 and titled "Grip/Cover for Key Lock System" is a continuation-in-part of U.S. Ser. No. 14/593,134 and claims the benefit and priority of U.S. Provisional Applications 62/056,172 and 62/232,393. U.S. patent application Ser. No. 15/015,773 was filed Feb. 4, 2016 and titled "Grip/Cover for Key Lock System" is a continuation-in-part of U.S. patent application Ser. Nos. 14/865,692 and 13/800,887, claims the benefit and priority of U.S. patent application Ser. Nos. 14/593,134 and 29/478.902, and claims the priority and benefit of U.S. Provisional Applications 62/056,172, 62/232,393, 61/925,451, 61/610,281, and 61/778,407. U.S. patent application Ser. No. 14/593,134 was filed Jan. 9, 2015, issued as U.S. Pat. No. 9,234,721 on Jan. 12, 2016, is titled "Cone Grip For Handgun," is a continuation of U.S. patent application Ser. No. 29/478,902 and claims priority and benefit of U.S. Provisional Application 61/925,451. U.S. patent application Ser. No. 13/800,887 filed Mar. 13, 2013 and titled "Powered Forward Module" claims the benefit and priority of U.S. Provisional Patent Applications 61/610,281 and 61/778,407. U.S. patent application Ser. No. 29/478,902 titled "Firearm Grip" was filed Jan. 9, 2014 and issued as Design Pat. No. D734,418 on Jul. 14, 2015. U.S. Provisional Application 62/056,172 is titled "Cover for Key Lock System" and was filed Sep. 26, 2014. U.S. Provisional Application 62/232,393 is titled "Grip/Cover For Key Lock System" and was filed Sep. 24, 2015. U.S. Provisional Patent Application 61/925,451 is titled "Cone Grip for Handgun" and was filed on Jan. 9, 2014. U.S. Provisional Patent Application 61/610,281 is titled "Powered Forward Module" and was filed on Mar. 13, 2012. U.S. Provisional Patent Application 61/778,407 is titled "Powered Forward Module" and was filed on Mar. 12, 2013. U.S. patent application Ser. Nos. 14/865,692, 14/593,134, 13/800,887, 29/478,902, and 15/015,773 are herein incorporated by reference in their entireties. U.S. Provisional Applications 62/056,172, 62/232,393, 61/925,451, 61/610,281 and 61/778,407 are herein incorporated by reference in their entireties.

TECHNICAL FIELD

Embodiments relate to the fields of firearms, firearm accessories, firearm rail mounting systems, and ergonomics.

BACKGROUND

One of the most common firearm platforms currently in use forms the basis for the military M-16, M-4, civilian AR-15, and a plethora of related firearms. One of the most convenient aspects of the AR platform family is that the parts and pieces can be mixed and matched to produce a wide variety of firearms having different capabilities, different appearances, and even different calibers.

FIG. 1, labeled as "prior art," illustrates an M16 type firearm 101 with mounting rails 106. The specific rifle is a flat top model having a mounting rail 106 on the upper receiver 102 as well as the four on the handguard 105. As is standard for M16 type firearms, the handguard 105 is attached to the firearm by being pushed into a front handguard cup 104 by a delta ring 103. The illustrated handguard 101 has four non-powered mounting rails 106 of which three are visible. A number of accessories have been developed to attach to small arms by way of mounting rails 106. The mounting rails have recoil grooves that help lock accessories in place and help users attach accessories in repeatable positions. Note that the term "firearm" used here and throughout this document is intended to include firearm replicas. In general, firearm replicas are toys or models that look substantially like fully functioning firearms and are designed to accommodate the same firearm accessories as those used with fully functional firearms. As such, FIG. 1 can also be a picture of a firearm replica. Certain M16 type firearms have "free floating" handguards that do not have a front handguard cup 104 or delta ring 103 but instead are clamped or bolted onto the firearm where the barrel is attached to the upper receiver.

FIG. 2, labeled as "prior art," illustrates a handguard 201 with key lock mounting points 202 and a mounting rail 106. Two types of firearm accessories can be attached to the handguard of FIG. 2. One type is accessories for Picatinny rails that are clamped to the rail 106 and that often interface with the recoil grooves in the mounting rail 106. The second type of accessory is those that attach to the key lock mounting points 202. The keylock mounting points in FIG. 2 are "keyhole shaped" in that they have a larger round hole with a rounded slot extending outward. Other handguards have keylock mounting points that are not keyhole shaped but instead are slots that typically have rounded ends or rounded corners.

FIG. 3, labeled as "prior art," illustrates three keylock mounting points 302 as viewed from the underside which would also be the inside of a keylock mounting system 301. The illustrated keylock mounting points are keyhole shaped with a larger round section 303 and a longer slotted section 304 extending out from the round section 303. The illustrated slotted section 304 has an angled inner surface 305. Other keylock mounting points do not have an angled inner surface 305, round section 303, or either.

FIG. 4, labeled as "prior art," illustrates a cut view of the keylock mounting point of FIGS. 2-3. FIG. 4 provides a more detailed view of the angled inner surface 305 of a slotted section 304.

Keylock mounting points are advantageous because they are, lighter than mounting rails but they experience difficulties because it can be more difficult to mount accessories to keylock mounting points than to mounting rails. Systems and methods for improving keylock systems for firearms are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification claims, drawings, and abstract as a whole.

Systems and methods for enhancing key lock mounting systems for small arms are needed.

It is therefore an aspect of the embodiments to provide a resilient cover that can be fastened to the mounting system and over the keyhole shaped openings. The cover has a main body and covers at least one, typically more, key lock mounting points. The cover uses keyhole grips to attach to the key lock mounting points. The keyhole grips extend from the bottom of the cover's main body and are shaped to fit into the keyhole shaped openings. The keyhole grips widen at the bottom such that they must be forcibly pushed into the keyhole opening. The resilience and shape of the cover material allows the keyhole grip to temporarily deform enough that the keyhole grip can be pushed into the keyhole opening. The keyhole grip is seated when the bottom of the cover's main body lies against the top surface of mounting system, such as that illustrated in FIGS. 1 and 2. Note that the shape of the keyhole grip causes the resilient material to be deformed less, or be not deformed at all when the cover is seated.

It is a further aspect of the embodiments that the cover body has a top that can be patterned. The pattern can be a texture, a geometric shape, a brand logo, or other design. The cover body itself can be solid or can have holes. For example, a round or oblong hole can extend from the top side of the cover body and down completely through the keyhole grips. Such an opening can provide for airflow through the key lock mounting point and through a cover installed on that mounting point.

While useful, a single-grip cover may be prone to rotation. As such some covers can have two or more keyhole grips spaced to attach to two or more key lock mounting points. Consecutive keyhole grips can fit into consecutive key lock mounting points or can spaced further apart. Areas of the cover overlaying a key lock mounting point and lacking a keyhole grip can have openings to allow heat or rubble to escape through the mounting point.

The cover is made of a material that is resilient enough the keyhole grip temporarily deforms during insertion into the key lock mounting point. Once fully inserted, the keyhole grip returns to is original shape or as close to that shape as possible given the dimensions of the keyhole mounting point. The material is also resilient enough that the cover can be repeatedly attached and removed from the key lock mounting system by pulling the cover away from the mounting system and without requiring access to or manipulation of the keyhole grip. The cover material should also be soft enough and resilient enough that the mounting system is not scratched, marred, or permanently deformed when the keyhole grips is pressed through the keyhole opening or when the cover is pulled off the mounting system. For example, a rubber cover can be used on an aluminum or hard plastic mounting system while an aluminum or steel cover is not resilient enough.

The cover material can also be resilient enough that it can be cut with normal handheld scissors or a knife, either wielded by an average human. In this manner a cover dimensioned to cover many key lock mounting points can be easily cut to thereby cover fewer key lock mounting points. The cover itself can have scribe lines formed into its top or bottom surface to indicate where the cover should be cut. If the scribe line is an indentation, it can help guide the cutting implement.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof. In general, the figures are not to scale.

Covers for key lock mounting systems on small arms such as the AR or M4 family of rifles and carbines can provide protection for the firearm and comfort for the operator. The cover has keyhole grips that are pressed into the key lock mounting points in mounting system. The cover is held seated against the surface of the mounting system by the shape and resilience of keyhole grips. V-notch keyhole grips can attach to keyhole shaped mounting points and slot shaped mounting points.

U.S. Ser. No. 14/593,134 was filed Jan. 9, 2015, is entitled "Cone Grip For Handgun" and is herein incorporated by reference in its entirety. U.S. Ser. No. 14/593,134 discloses a handgrip having an overmold and a substrate. It is for its teachings of grips, overmolds, and substrates that U.S. Ser. No. 14/593,134 is herein included by reference in its entirety.

Provisional Application 62/056,172 was filed Sep. 26, 2014, is entitled "Cover For Key Lock Systems" and is herein incorporated by reference in its entirety. Provisional Application 62/056,172 discloses prior art keylock systems for mounting accessories to firearms and discloses a variety of embodiments of covers for key lock systems, many of which are also taught in this application. It is for its teachings of keylock systems and covers for keylock systems that Provisional Application 62/056,172 is herein included by reference in its entirety.

Provisional Application 62/232,393 was filed Sep. 24, 2015, is entitled "Cover For Key Lock Systems" and is herein incorporated by reference in its entirety. Provisional Application 62/232,393 discloses prior art keylock systems for mounting accessories to firearms and discloses a variety of embodiments of covers for key lock systems, many of which are also taught in this application. It is for its teachings of keylock systems and covers for keylock systems that Provisional Application 62/232,393 herein included, by reference in its entirety.

Figure 5:
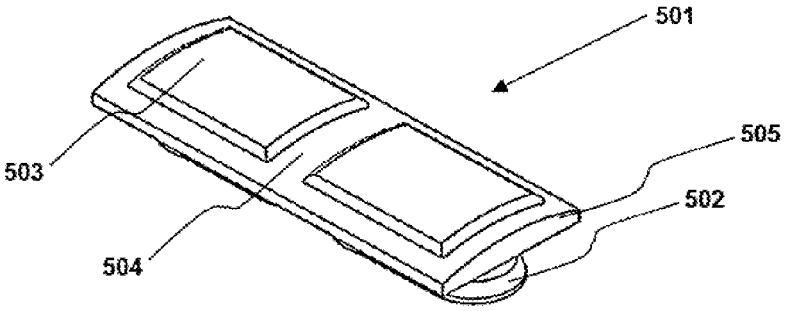
FIG. 5 illustrates a cover having key shaped keyhole grips in accordance with aspects of the embodiments.

FIG. 5 illustrates a cover 501 having key shaped keyhole grips 502 in accordance with aspects of the embodiment. The cover body 505 has raised surface 503 over the keyhole grips and a non-raised surface 504 elsewhere such as between the keyhole grips.

Figure 6:
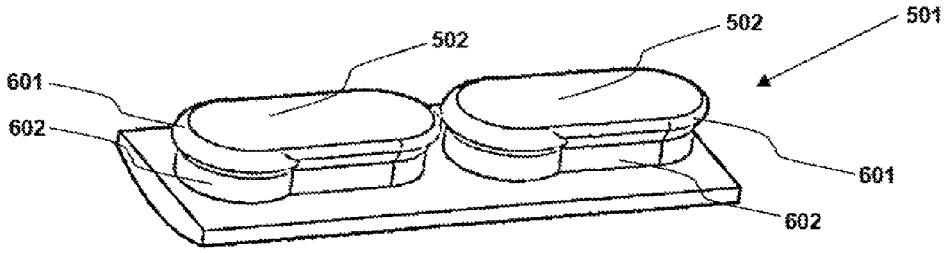
FIG. 6 illustrates a different view of the cover of FIG. 5 in accordance with aspects of the embodiments.

FIG. 6 illustrates a different view of the cover 501 of FIG. 5 in accordance with aspects of the embodiments. The keyhole grips 502 can be seen to be keyhole shaped and to have a narrow part 602 and a wide part that has a rounded lower portion 601.

Figure 7:
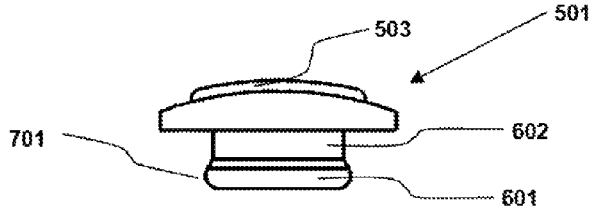
FIG. 7 illustrates a side view of the cover of FIGS. 5-6 in accordance with aspects of the embodiments.

FIG. 7 illustrates a side view of the cover 501 of FIGS. 5-6 in accordance with aspects of the embodiments. The raised surface 503 can be seen as can the narrow part 602 and the wide part 601 of the keyhole grip 502. Also more clearly visible is the widest part 701 of the wide part 601. Pressing the keyhole grip 502 into a key lock mounting point 302 causes the keyhole grip to deform until the widest, part 701 has been pressed through the opening. Being made of resilient material, the keyhole grip attempts to return to its original shape and the widest part 701 presses out. When pressed into a mounting point such as that of FIGS. 3-4, the widest part presses out and into the angled inner surface. It is this action of the keyhole grip pressing out and into the side of the keyhole mounting point that holds the cover 501 and all similar covers onto keylock mounting systems.

Figure 8:
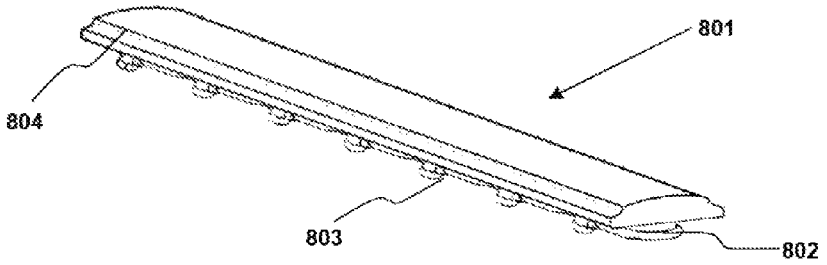
FIG. 8 illustrates a cover having a step-patterned top surface and stepped keyhole shaped keyhole grips in accordance with aspects of the embodiments.

FIG. 8 illustrates a cover 801 having a step-patterned top surface 804 and keyhole grips 802 with stepped wide parts 803 in accordance with aspects of the embodiments. The stepped wide part allows the keyhole grip to better match the stepped contour on the underside of keyhole mounting points such as those of FIGS. 3-4 in which part of the underside has an angled surface and another part does not.

Figure 9:
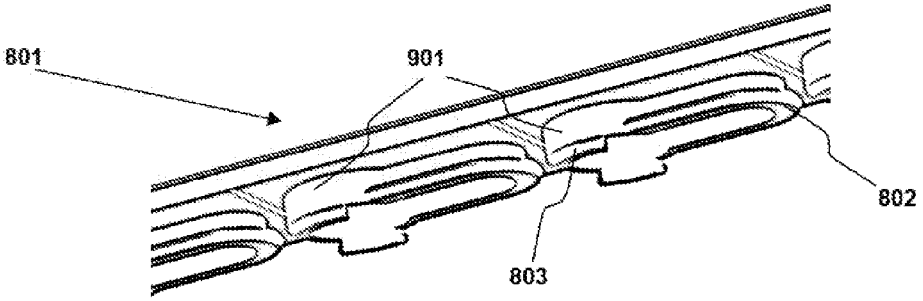
FIG. 9 illustrates a different view of the cover of FIG. 8 in accordance with aspects of the embodiments.

FIG. 9 illustrates a different view of the cover 801 of FIG. 8 in accordance with aspects of the embodiments. As with other keyhole grips, the keyhole grip of FIG. 9 has a narrow part 901. The stepped wide part has a first rounded lower portion 802 and a second rounded lower portion 803.

Figure 10:
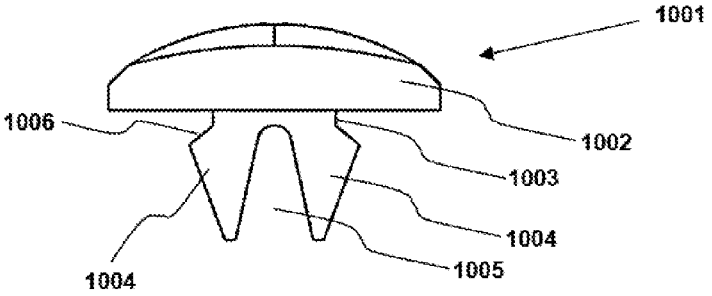
FIG. 10 illustrates a cover with a keyhole grip having two wedges and a which in accordance with aspects of the embodiments.
Figure 11:
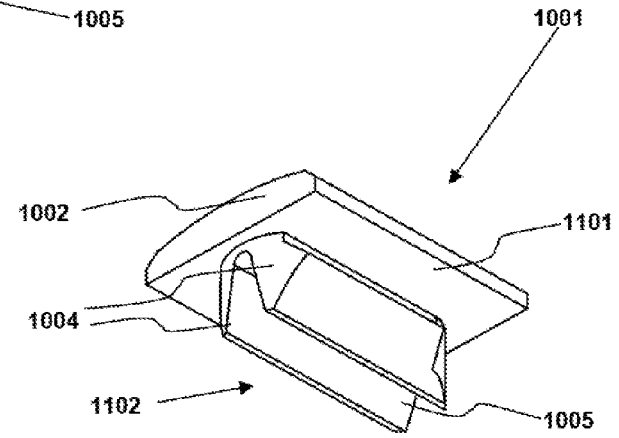
FIG. 11 illustrates a view from the underside of the cover of FIG. 10 in accordance with aspects of the embodiments.
Figure 12:
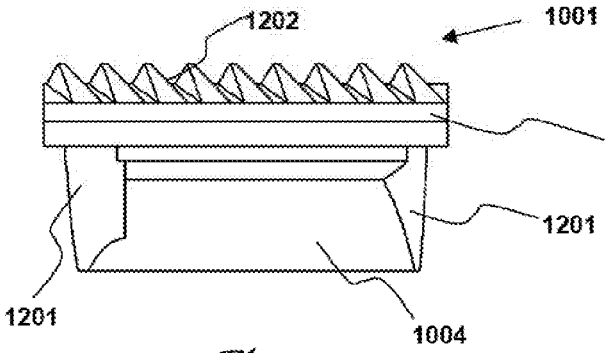
FIG. 12 illustrates a side view of the cover of FIGS. 10-11 in accordance with aspects of the embodiments.
Figure 13:
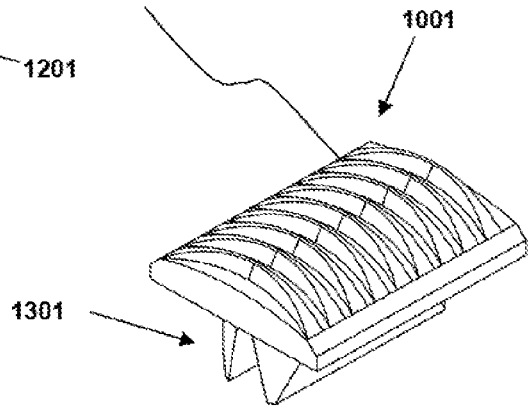
FIG. 13 illustrates a view from above of the cover of FIGS. 10-12 in accordance with aspects of the embodiments.
Figure 14:
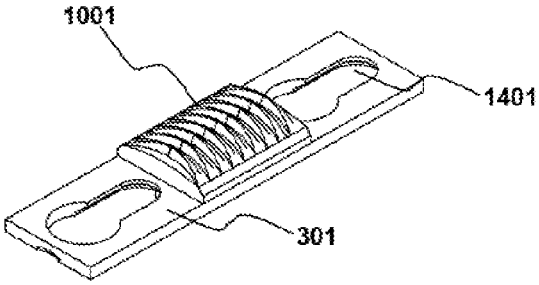
FIG. 14 illustrates a view from above of the cover of FIGS. 10-13 attached to a keyhole mounting point such as that of FIG. 3 in accordance with aspects of the embodiments.
Figure 15:
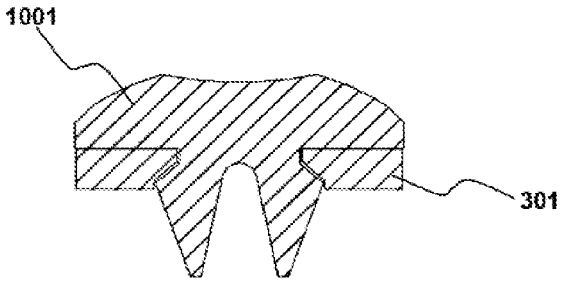
FIG. 15 illustrates a cut view of the assembly illustrated in FIG. 14 in accordance with aspects of the embodiments.

FIGS. 10-15 illustrate a cover 1001 with a keyhole grip 1102 having two wedges 1004 and a v-notch 1005 in accordance with aspects of the embodiments. The cover has a cover body 1002 with a cover top 1202 and a cover bottom 1101. The keyhole grip 1102 has a narrow part 1103 and a wide part 1301 with the wedges 1004 being part of the wide part. The wedges 1104 have an upper surface 1006. FIG. 12 illustrates an aggressively patterned cover top 1202 whereas other cover tops can be smooth, lightly textured, or otherwise patterned. FIGS. 14-15 show the cover 1001 fixed to a keyhole system 301. The illustrated keyhole system has keyhole shaped keyhole mounting points although cover 1001 can as easily be fixed to slot shaped keyhole mounting points. FIG. 12 shows that this particular embodiment has round ends 1202 that can have a radius equal to that of the rounded slot ends 1401. FIG. 15 shows that the upper surfaces 1006 of the wedges 1004 are angled such that they have the same angle as the slot's inner surface 305 when the cover 1001 is installed in slot 302. Other inner surface angles can be used. For example, a different angle can make the cover 1001 easier to pull from the slot 302.

FIG. 10 illustrates a front view of the cover of FIGS. 10-15. FIG. 11 illustrates a view from the underside of the cover of FIGS. 10-15. FIG. 12 illustrates a side view of the cover of FIGS. 10-15. FIG. 13 illustrates a view from above of the cover of FIGS. 10-15. FIG. 14 illustrates a view from above of the cover of FIGS. 10-15 attached to a keyhole mounting point such as that of FIG. 3. FIG. 15 illustrates a cut view of the assembly illustrated in FIG. 14.

Figure 16:
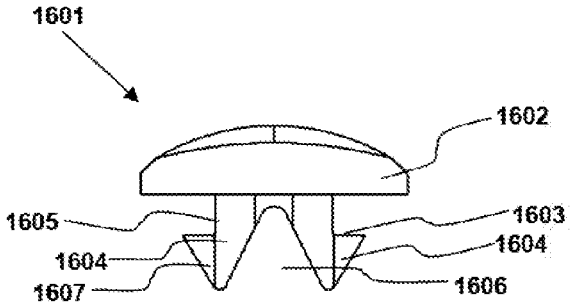
FIG. 16 illustrates a cover having a V-notch keyhole grip and an upper outer surface shaped to match a key lock mounting points with non-angled inside surfaces. In accordance with aspects of the embodiments.
Figure 17:
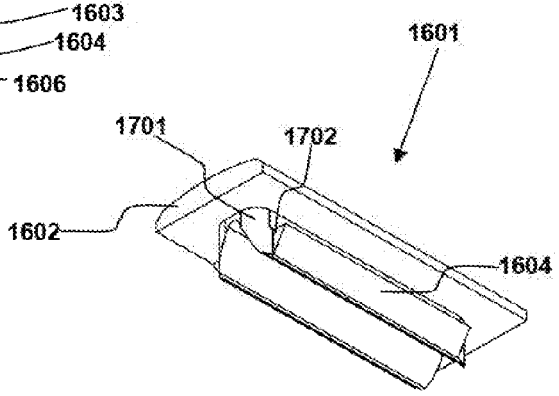
FIG. 17 illustrates a view from the underside of the cover of FIG. 16 in accordance with aspects of the embodiments.
Figure 18:
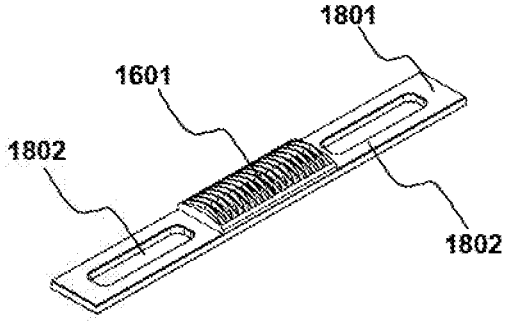
FIG. 18 illustrates a view from above of the cover of FIGS. 16-17 attached to a slot shaped keyhole mounting point in accordance with aspects of the embodiments.
Figure 19:
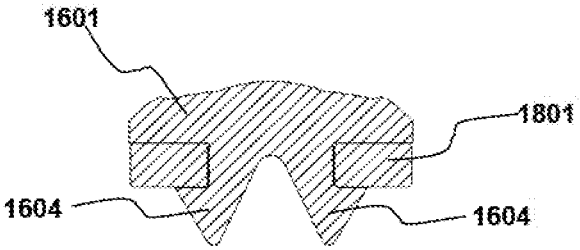
FIG. 19 illustrates a cut view of the assembly illustrated in FIG. 18 in accordance with aspects of the embodiments.

FIGS. 16-19 illustrate a cover 1601 having a V-notch keyhole grip and wedge upper surfaces 1603 shaped to match a key lock mounting points with non-angled inside surfaces. In accordance with aspects of the embodiments. As with the other covers, cover 1601 has cover body 1602 and a keyhole grip with a wide part and a narrow part 1605. The wide part has two wedges 1604 with a v-notch 1606 between them. The wedges 1604 have non-angled upper surfaces 1603. The wedge in this embodiment have clips 1607 with flat clip ends 1702 with the remainder of the wedge ends rounded 1701. FIGS. 18-19 show cover 1601 fixed to a keyhole mounting system 1801. The illustrated keyhole mounting system 1801 has slot shaped key hole mounting points 1802. As can be seen in FIG. 19, these particular keyhole mounting points do not have angled inner surfaces.

FIG. 16 illustrates a front view of cover 601 FIG. 17 illustrates a view from the underside of cover 1601. FIG. 18 illustrates a view from above of cover 1601 attached to a slot shaped keyhole mounting point 1802 FIG. 19 illustrates a cut view of the assembly illustrated in FIG. 18.

Figure 20:
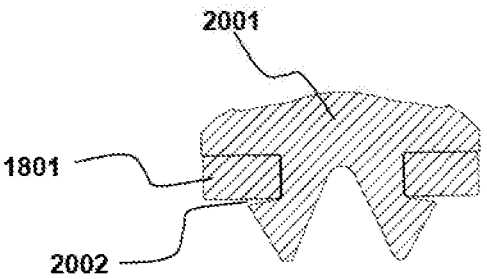
FIG. 20 illustrates a cut view of an assembly similar to that illustrated in FIG. 18 excepting for a slight angling of the upper surface of the keyhole grip in accordance with aspects of the embodiments.

FIG. 20 illustrates a cut view of an assembly similar to that illustrated in FIGS. 18-19 excepting for that the cover 2001 has a slight angling of the upper surface 2002 to make it easier to pull the cover 2001 from the keyhole mounting assembly 1801.

FIGS. 21-24 illustrate a cover 2101 similar to that of FIGS. 10-15 excepting for more rounded front and back keyhole grip ends 2201 while the front and back clip ends 2107 are flat in accordance with aspects of the embodiments. The cover 2101 has a cover body 2102 and a keyhole grip a narrow part 2105 with two wedges 2104 and a v-notch 2106. The wedges in this embodiment have angled upper surfaces 2103.

Figure 21:
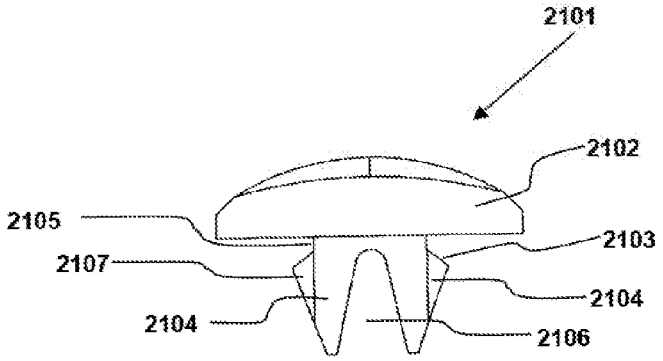
FIG. 21 illustrates a cover similar to that of FIGS. 10-15 excepting for more rounded front and back keyhole grip ends while the front and back clip ends are flat in accordance with aspects of the embodiments.
Figure 22:
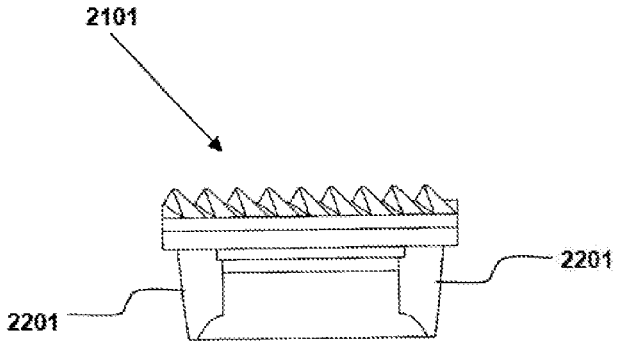
FIG. 22 illustrates a side view of the cover of FIG. 21 in accordance with aspects of the embodiments.
Figure 23:
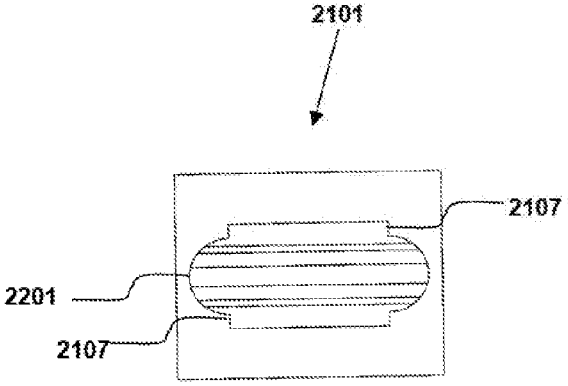
FIG. 23 illustrates a bottom view of the cover of FIGS. 21-22 in accordance with aspects of the embodiments.
Figure 24:
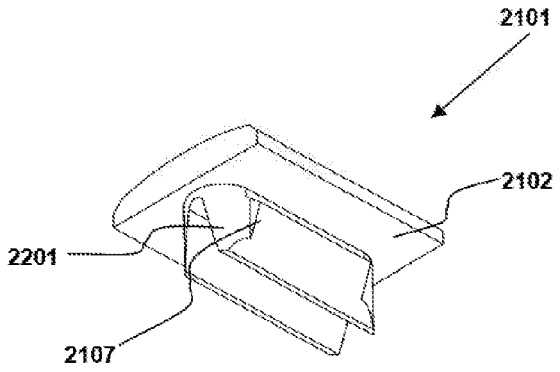
FIG. 24 illustrates a view from the underside of the cover of FIGS. 21-23 in accordance with aspects of the embodiments.

FIG. 21 illustrates a front view of cover 2101. FIG. 22 illustrates a side view of cover 2101. FIG. 23 illustrates a bottom view of cover 2101. FIG. 24 illustrates a view from the underside of cover 2101.

Figure 25:
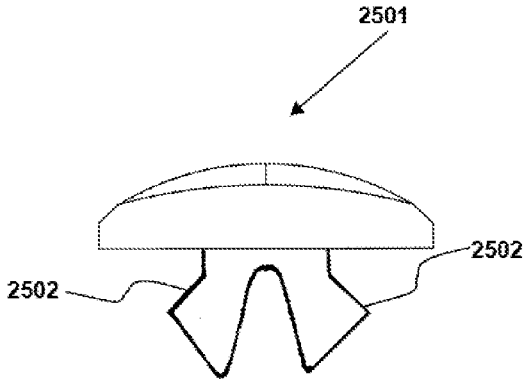
FIG. 25 illustrates a profile of a cover having an extend angled surface that s harder to pull of the mounting system in accordance with aspects of the embodiments.

FIG. 25 illustrates a profile of a cover 2501 having an extended angled upper surface 2502 that is harder to pull off a mounting system because the keyhole grip must deform more than for a cover with a narrower keyhole grip.

Figure 26:
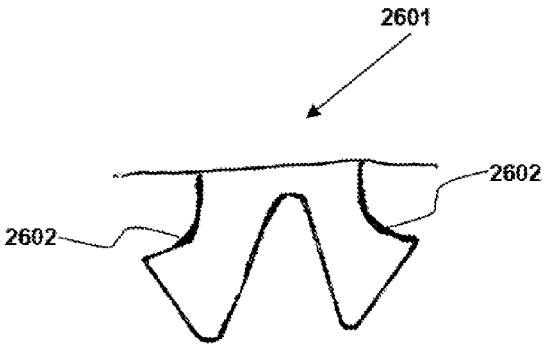
FIG. 26 illustrates a profile of a cover having a curved surface on the wedge tops to accommodate keyhole mounting points with and without angled inner surfaces in accordance with aspects of the embodiments.

FIG. 26 illustrates a profile of a keyhole grip 2601 for cover having a curved surface 2602 on the wedge tops in order to accommodate keyhole mounting points with and without angled inner surfaces.

Figure 27:
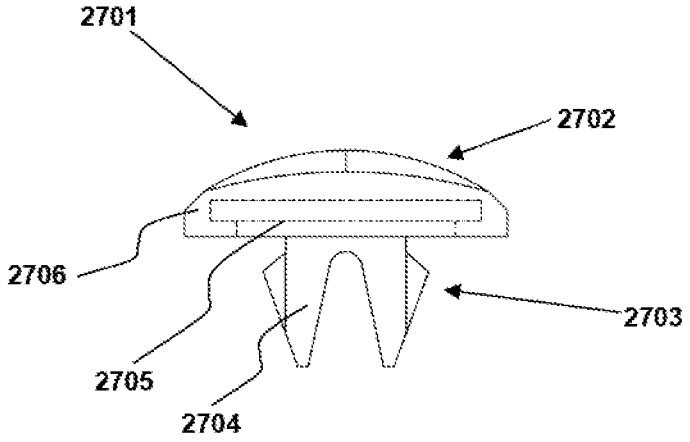
FIG. 27 illustrates a front view of a cover having a substrate and over old in accordance with aspects of the embodiments.
Figure 28:
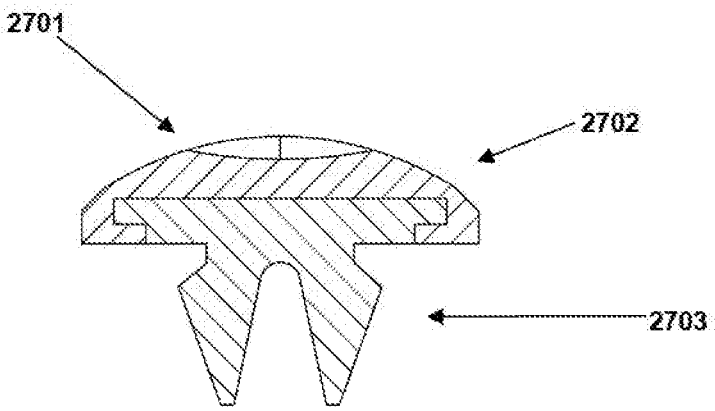
FIG. 28 illustrates a cut view of the cover of FIG. 27 and showing the substrate in accordance with aspects of the embodiments.

FIGS. 27-28 illustrate a front view of a cover 2701 having a substrate 2703 and overmold 2702 in accordance with aspects of the embodiments. The substrate 2703 includes the keyhole grip 2704 and a lower portion 2705 of the cover body 2706. The overmold is a plastic that provides structural rigidity to the cover while the overmold is a softer plastic that provides an ergonomic gripping surface and form. The substrate material is not only more rigid than the overmold material but also gives the keyhole grip a less resilient surface than the overmold material. The less resilient surface is less prone to binding in a key hole mounting points before the keyhole grip is fully inserted. The substrate material typically has a higher melting point than the overmold material such that substrates can be formed first and then overmolds cast directly over and into the substrates.

FIG. 27 illustrates a front view of a cover 2701 having substrate 2703 and overmold 2703. FIG. 28 illustrates a cut view of the cover 2701 and shows substrate 2703 and overmold 2704 in accordance with aspects of the embodiments.

Figure 29:
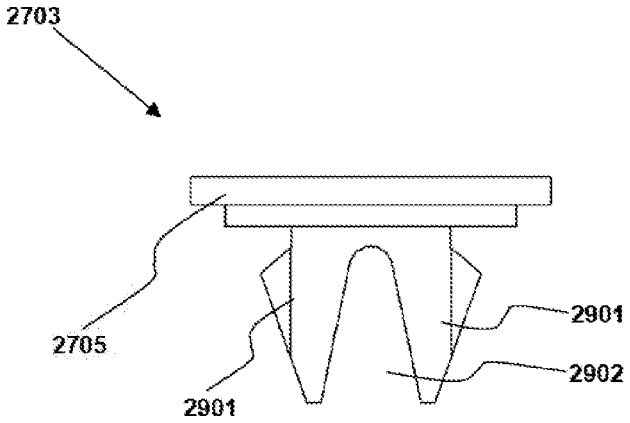
FIG. 29 illustrates a front view of the substrate of the cover of FIGS. 27-28 in accordance with aspects of the embodiments.
Figure 30:
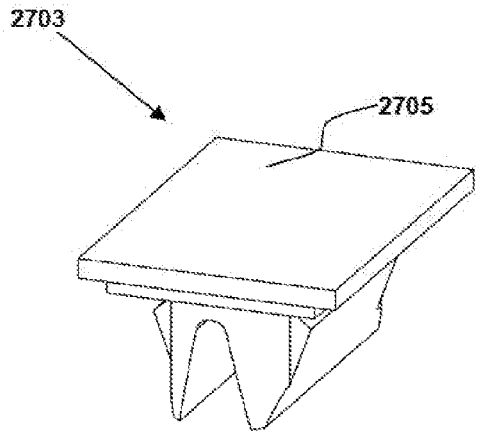
FIG. 30 illustrates a view from above of the substrate of FIG. 29 in accordance with aspects of the embodiments.
Figure 31:
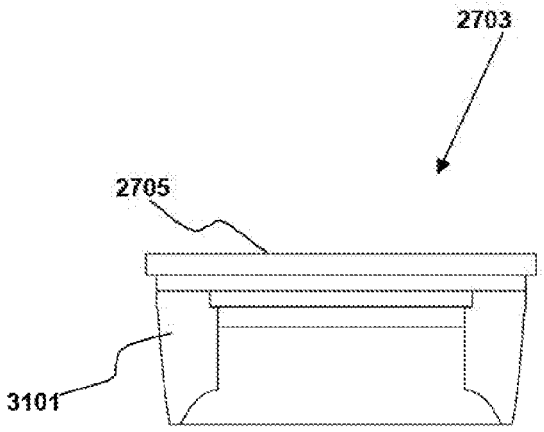
FIG. 31 illustrates a side view of the substrate of FIGS. 29-30 in accordance in aspects of the embodiments.

FIGS. 29-31 illustrate aspects of substrate 2703 of FIGS. 27-28. The substrate is typically a single molded piece with the lower cover body 2705 and keyhole grip 2704 which has wedges 2901 and v-notch 2902. It should be noted that the keyhole grip of cover 2701 can very similar, even identical, in form, to the keyhole grips of other embodiments contemplated herein. Many of the other embodiments are formed from a single piece of material whereas cover 2701 is formed from two materials. Although the substrate material is more rigid than the overmold material, the substrate material must be resilient enough that the keyhole grip can be pressed into a key hole mounting point without breaking and must be resilient enough that the wedges press outward and hold the cover to the mounting system.

FIG. 29 illustrates a front view of substrate 2703. FIG. 30 illustrates a view from above of substrate 2703. FIG. 31 illustrates a side view of substrate 2703.

Figure 32:
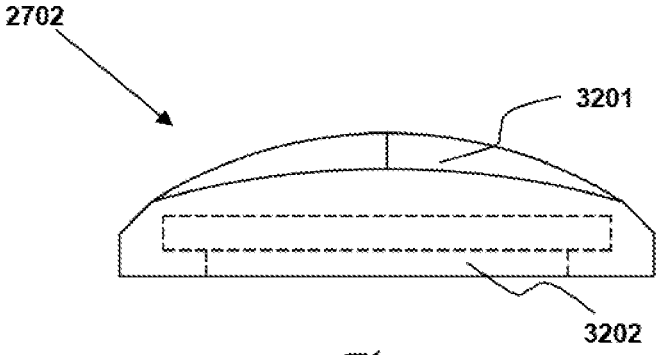
FIG. 32 illustrates a front view of the over old of the cover of FIGS. 27-28 in accordance with aspects of the embodiments.
Figure 33:
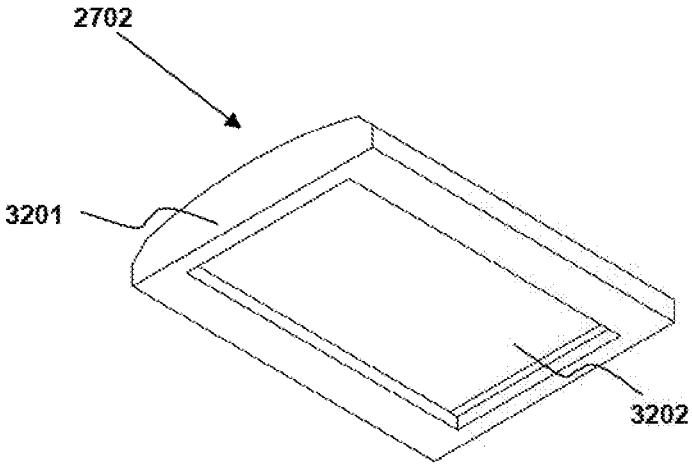
FIG. 33 illustrates a view from below of the over laid of the cover of FIG. 32 in accordance with aspects of the embodiments.

FIGS. 32-33 illustrate a views and aspects of overmold 2702 of cover 2701 of FIGS. 27-28 in accordance with aspects of the embodiments. Overmold 2702 includes the top portion of the cover body 3201 and a cavity 3202 into which the top portion 2705 of the substrate 2703 fits.

FIG. 32 illustrates a front view of overmold 2702. FIG. 33 illustrates a view from below of overmold 2702.

An embodiment similar to that of FIGS. 27-33 reverses the overmold and the substrate elements such that the elements illustrated in FIGS. 29-31 become the overmold are made of the softer more resilient overmold material and such that the elements illustrated in FIGS. 32-33 become the substrate and are made of the harder and less resilient substrate material.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A cover for a firearm fore end comprising a plurality of key lock mounting points, the cover comprising:

a cover body comprising a cover top, and a cover bottom wherein the cover body comprises a resilient material; and a keyhole grip comprising a narrow part and a wide part, wherein the keyhole grip is fixed to the cover bottom, wherein the keyhole grip is dimensioned to be pressed into at least one point of the plurality of key lock mounting points, wherein the keyhole grip and the cover body are a single piece of the resilient material, wherein pressing the keyhole grip into the key lock mounting point causes the wide part to deform more than the narrow part, wherein the narrow part is between the wide part and the bottom of the cover body, wherein the wide part comprises two wedges, wherein pressing the keyhole grip into the key lock mounting point causes the wedges to press together until a widest part of the wide part has passed through the key lock mounting point, wherein the wedges press back apart as the widest part is pressed past the key lock mounting point, and wherein the two wedges are separated by a v-notch.

Figure 1:
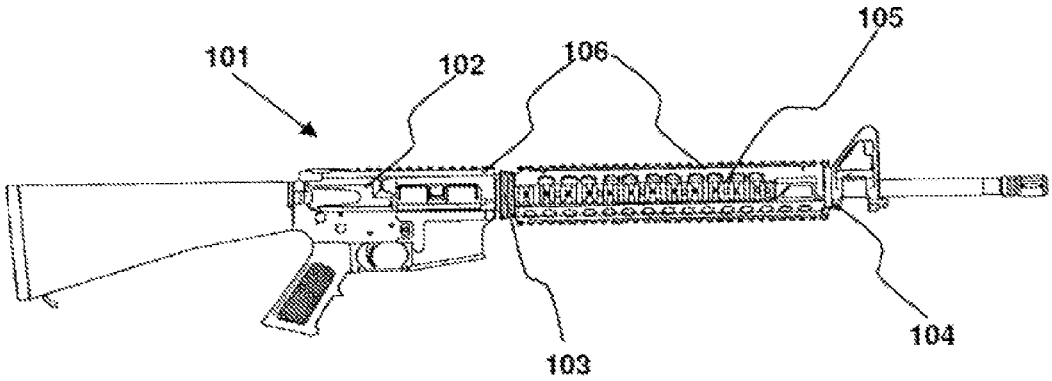
Fig. 1 (Prior Art)
FIG. 1, labeled as "prior art," illustrates an M16 type firearm 101 with mounting rails 106.
Figure 2:
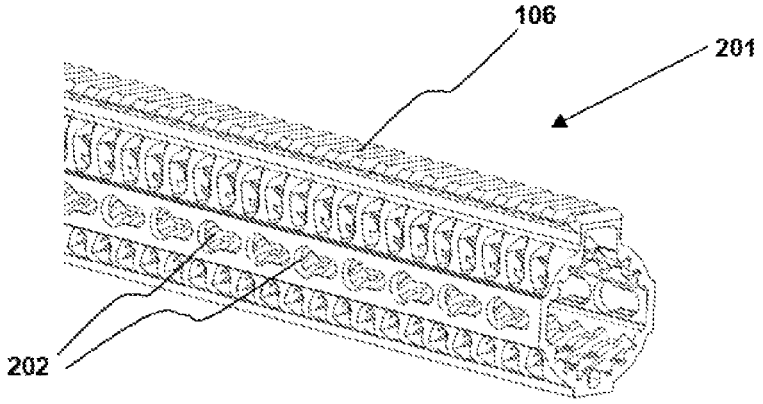
Fig. 2 (Prior Art)
FIG. 2, labeled as "prior art," illustrates a handguard 201 with key lock mounting points 202 and a mounting rail 106.
Figure 3:
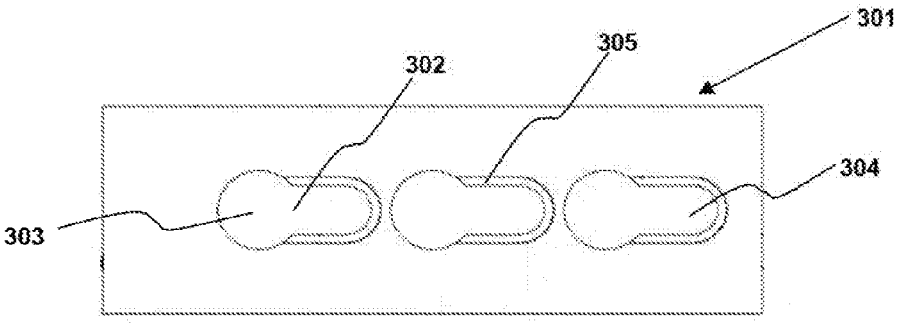
Fig. 3 (Prior Art)
FIG. 3, labeled as "prior art" illustrates three keylock mounting points as viewed from the underside which would also be the inside of the keylock mounting system.
Figure 4:
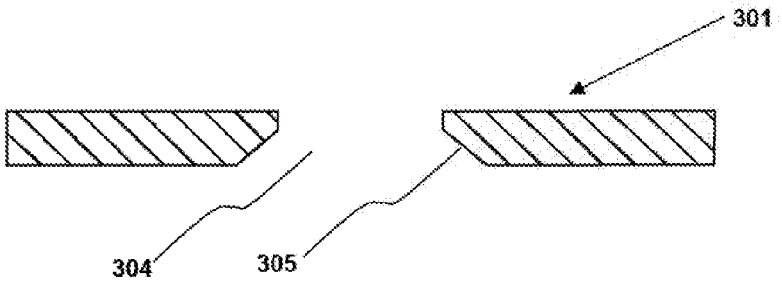
Fig. 4 (Prior Art)
FIG. 4, labeled as "prior art," illustrates a cut view of the keylock mounting point of FIGS. 2-3.

2. The cover of claim 1 wherein the wide part comprises a rounded lower portion, wherein the rounded lower portion is attached to a bottom edge of the narrow part to thereby form the wide part, wherein the key lock mounting point is keyhole shaped as illustrated in FIGS. 2-4 of the drawings, and wherein the wide part is stepped such that the rounded lower portion is discontinuous.

3. The cover of claim 1 wherein the key lock mounting point is slot shaped, wherein the key lock mounting point is not keyhole shaped wherein the key lock mounting point comprises an angled inside surface, and wherein the two wedges are angled at their tops to match the angled inside surface.

4. The cover of claim 1 wherein the key lock mounting point is slot shaped, wherein the key lock mounting point is not keyhole shaped, wherein the key lock mounting point comprises a non-angled angled inside surface, and wherein the two wedges are not angled at their tops to thereby match the non-angled inside surface.

5. The cover of claim 2 further comprising a firearm, the firearm fore end, a second key lock mounting point, a second keyhole grip, a third key lock mounting point, and a third keyhole grip, wherein the second key lock mounting point is slot shaped, wherein the second key lock mounting point is not keyhole shaped, wherein the wide part of the second keyhole grip comprises two second grip wedges, wherein pressing the second keyhole grip into the second key lock mounting point causes the second wedges to press together until a widest part of the wide part of the second keyhole grip has passed through the second key lock mounting point, wherein the second wedges press back apart when the widest part of the second keyhole grip is pressed through the second key lock mounting point, wherein the second wedges are separated by a v-notch, wherein the second key lock mounting point comprises a second angled inside surface, and wherein the second wedges are angled at their tops to match the second angled inside surface, wherein the third key lock mounting point is slot shaped, wherein the third key lock mounting point is not keyhole shaped, wherein the wide part of the third keyhole grip comprises two third wedges, wherein pressing the third keyhole grip into the third key lock mounting point causes the third wedges to press together until a widest part of the wide part of the third keyhole grip has passed through the third key lock mounting point, wherein the third wedges press back apart when the widest part of the third keyhole grip is pressed through the third key lock mounting point, wherein the third key lock mounting point comprises a non-angled angled inside surface, and wherein the two third wedges are not angled at their tops to thereby match the non-angled inside surface, wherein the cover top comprises a raised surface above the keyhole grip, the second keyhole grip, and the third keyhole grip and a non-raised surface between the keyhole grip and the second keyhole grip and between the second keyhole grip and the third keyhole grip.

* * * * *